United States Patent [19]

Ekander et al.

[11] Patent Number: 4,820,342

[45] Date of Patent: Apr. 11, 1989

[54] METHOD OF REDUCING LINING WEAR

[75] Inventors: Hans Ekander; Clas Ericson; Göte Tallbäck; Hernan Tinoco; Staffan Öström, all of Västerås, Sweden

[73] Assignee: Ases Brown Boveri AB, Västerås, Sweden

[21] Appl. No.: 180,333

[22] Filed: Apr. 11, 1988

[30] Foreign Application Priority Data

Apr. 13, 1987 [SE] Sweden ..... 8701525

[51] Int. Cl.[4] ..... C22B 4/00

[52] U.S. Cl. ..... 75/10.65; 75/10.16

[58] Field of Search ..... 75/10.65, 10.14, 10.16; 373/4

[56] References Cited

U.S. PATENT DOCUMENTS 2,139,853 12/1938 Rohn ..... 75/10.16

3,160,497 12/1964 Loung ..... 75/10.14

3,246,373 4/1966 Lyman ..... 373/4

*Primary Examiner*—Peter D. Rosenberg

*Attorney, Agent, or Firm*—Watson, Cole, Grindle & Watson

[57] ABSTRACT

Lining wear in an arc heated ladle containing a bath of melt and slag is reduced by rotating the melt in a horizontal direction to provide a concave bath surface in which the slag accumulates towards the center, thus preventing the slag attacking the ladle lining. In addition to heating the charge, the arc or arcs melt(s) the slag whereas the lining is partly protected from the radiation by the concave surface. A flow perturbing means is arranged at the ladle to attain an increased homogenization and the possibility of intensified sulfur removal.

11 Claims, 2 Drawing Sheets

METHOD OF REDUCING LINING WEAR

BACKGROUND OF THE INVENTION

The present invention relates to a method of reducing lining wear during arc heating of an electromagnetically stirrable bath of melt in a ladle in which the melt is made to rotate in the horizontal direction, whereby the upper surface of the melt acquires an at least approximate parabolic shape.

DISCUSSION OF PRIOR ART

A method and a device for increasing the efficiency of reactions between slag and melt in a bath of molten metal, for example in connection with sulfur removal from steel melts, is discussed in U.S. Pat. No. 4,778,518, commonly owned herewith. In this application, stirring of melt takes place by means of at least one inductive stirrer, the stirring being performed in such a way that the vector responsible for the stirring force has both horizontal and vertical components.

One problem in connection with the arc heating of baths of steel melts in a ladle is the severe wear of the refractory lining of the ladle which is caused, inter alia, by thermal stress caused by direct radiation from the arc. Another problem arises in connection with the need to ensure good mixing of the steel melt and slag, for example for sulfur removal. Achieving good homogenization of a melt may also present a problem.

The invention aims to provide a solution to the above-noted problems and is an improvement of the method described in the above-mentioned patent application.

SUMMARY OF THE INVENTION

The method according to the invention is characterized in that the melt is stirred to cause slag to be accumulated towards the center of the ladle, thus reducing the risk of damage to the lining by slag attack, in that the at least one arc, in addition to heating the charge of molten metal, also melts the slag, in that the lining is partially protected from arc-radiation, and further that melt-flow perturbing means (such as a ceramic pole or refractory brick projecting into the melt, a ceramic wing located in the melt below the bath surface, or an electromagnetic brake) is provided to perturb the interface between the melt and the slag in order to achieve better mixing of the steel melt and the slag, for example for improving the efficiency of sulfur removal.

Bath stirring, which is suitably produced using a horizontally acting, electromagnetic stirrer fed with multi-phase current, is carried out such that the melt and the slag are made to rotate. Wide flexibility with respect to the flow pattern induced in the rotating melt is possible. During horizontal rotation of the melt, the slag moves onwardly towards the center below the arc electrodes and will thus be subjected to the highest temperatures. In addition, by the action of the perturbing means turbulence is created in the melt, which has metallurgical advantages such as improving the efficiency of sulfur removal and improving homogenization.

By using a method according to the present invention, contact between the slag and the lining can be avoided and the wear of the lining can be reduced. The parabolic surface of the melt caused by the stirring gives rise to a raised peripheral region which serves to protect the ladle wall from radiation from the arc(s).

In one embodiment of the present invention, a steel melt is stirred by a first horizontally acting electromagnetic stirrer and by a second vertically acting stirrer spaced-apart from the first stirrer. The two stirrers can conveniently be diametrically located with respect to the ladle. The second stirrer can be used to increase the homogenization of the melt.

By increasing the height of the parabola defining the melt surface by increasing the rate of horizontal rotation, the arc current and the rate of electrode consumption can both be reduced.

BRIEF DESCRIPTION OF THE DRAWINGS

The invention will be exemplified in greater detail with reference to the accompanying drawings, wherein.

DESCRIPTION OF THE PREFERRED EMBODIMENTS

Figure 1A:
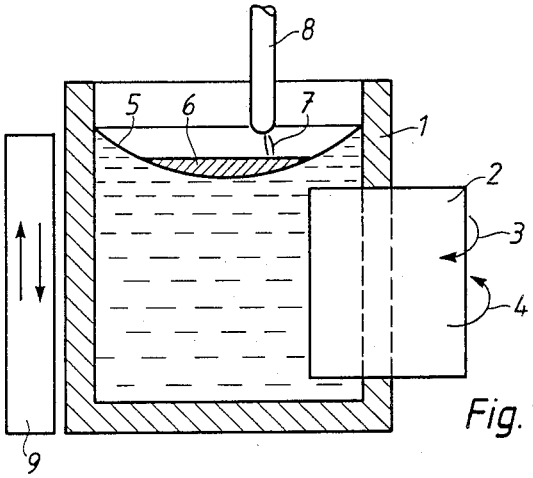
FIGS. 1*a* and 1*b* show a sectional side view and plan of a ladle showing the use of two stirrers to create a parabolic surface to melt in the ladle.
Figure 1B:
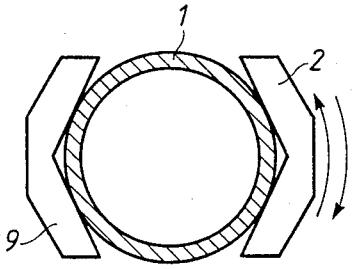

FIG. 1*a* shows a melt-containing ladle 1. An electromagnetic stirrer 2, fed with multi-phase current, is located at one side of the ladle 1. FIG. 1*b* shows the same arrangement seen from above. By selecting the direction of the travelling field, stirring of the melt can take place in either of the directions of the alternative arrows 3 and 4. The stirring leads to a rotation of the melt, in this case a steel melt, and the surface 5 of the steel melt attains a concave or parabolic shape as indicated. Slag 6 on the surface 5 accumulates in the center and is therefore easily melted down by an arc 7 from an arcing electrode 8. Only one electrode 8 is shown in FIG. 1*a* but a plurality of electrodes could be used. The concave surface 5 substantially protects the lining of the ladle 1 from direct incidence by radiation from the arc 7. Substantial protection is also obtained against direct contact between the slag 6 and the lining of the walls of the ladle 1 which considerably increases the working life of the lining. If desired, the stirrer 2 can be supplemented with a vertical stirrer 9, which stirs in the vertical direction and increases the homogenization of the melt as well as reducing temperature gradients. The slag 6 accumulated at the center will thus be readily melted down. Refining effects, such as sulfur removal, can be obtained and possibly improved. In this connection also an efficient mixing of steel and slag is obtained. The ladle 1 is provided with a perturbing means as will be described below.

Figure 2A:
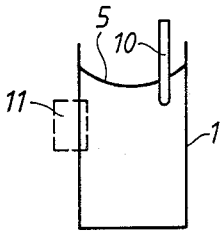
FIGS. 2*a* and 2*b* are a simplified side view and plan which illustrate the use of a refractory pole.
Figure 2B:
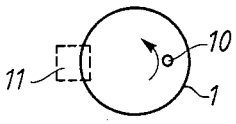

FIGS. 2*a* and 2*b* show the immersion of a perturbing pole 10 of ceramic, or other refractory material, into the melt. This disturbs the stirring from the horizontally acting stirrer 11 and leads to a more efficient mixing of steel and slag, which, among other things, increases the intensity of the sulfur removal. FIG. 2*b* shows the stirring direction and the ceramic pole 10, which is arranged eccentrically and extends through the interface between the steel melt and the slag 6.

Figure 3A:
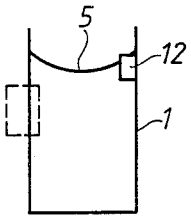
FIGS. 3*a* and 3*b* are a simplified side view and plan which illustrate the use of a refractory stone.
Figure 3B:
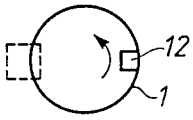

FIGS. 3*a* and 3*b* show a device similar to that shown in FIGS. 2*a*, 2*b* but the perturbing means is in the form of a ceramic brick 13, projecting into the melt, suitably below the surface of the melt, from the ladle wall. In the same way as in the case of the above-mentioned pole 10, a disturbance of the stirring and hence an intensified mixing of slag and steel is obtained. The ceramic brick 12 should have dimensions such that it projects into the melt in or immediately below its surface 5 from the inner wall of the ladle (see FIG. 3*b*).

Figure 4A:
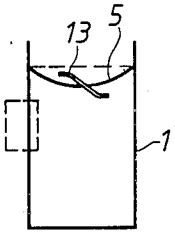
FIGS. 4*a* and 4*b* are a simplified side view and plan which illustrate the use of a refractory wing.
Figure 4B:
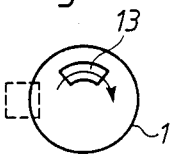

An alternative embodiment of a perturbing means is shown in FIGS. 4*a* and 4*b*, in which a refractory wing 12 has been arranged in or below the melt surface. The wing is shaped to disturb the flow and occasion intensified mixing of slag and steel melt.

Figure 5:
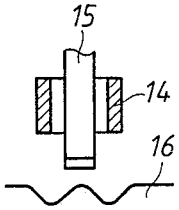
FIG. 5 is a schematic view of an electromagnetic perturbing means for use in the method of the invention.
Figure 6A:
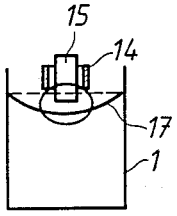
FIGS. 6*a* and 6*b* are a schematic side view and plan of how the perturbing means of FIG. 5 could be used in the method of the invention.
Figure 6B:
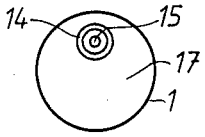

FIG. 5 shows an electromagnetic perturbing means, comprising a coil 14 and an iron core 15. The iron core 15 projects down towards the melt and urges the melt downwardly when the coil 14 is supplied with current (note the surface perturbation indicated at 16). The use of electromagnetic perturbing means is also indicated in FIGS. 6*a* and 6*b*, in which the parabolic surface is shown at 17 (the stirrer(s) not being shown). FIGS. 6*a*, 6*b* also show the iron core 15 and the coil 14 which locally depress the melt surface to an additional extent for the purpose of intensifying the rate of mixing. Electromagnetic devices which locally decelerate the melt may, for example, give a stationary a.c. field, a travelling field (suitably with a frequency different from that of the stirrer), and a d.c. field. The position of the perturbing pole 15 is also shown in FIG. 6*b*, which is a plan from above of the ladle shown in section in FIG. 6*a*.

Figure 7A:
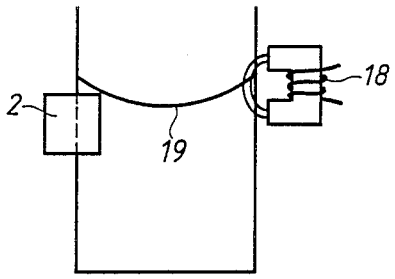
FIGS. 7*a* and 7*b* are a schematic view and plan of a perturbing means in the form of a horseshoe electromagnet.
Figure 7B:
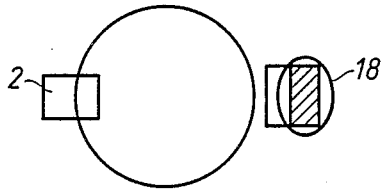

FIGS. 7*a* and 7*b* shown a horseshoe magnet 18 supplied with direct current and acting at a location in the ladle diametrically opposite to that of the stirrer 2, which acts in the horizontal direction in order to generate a parabolic melt surface 19. The d.c. magnet 18 decelerates the melt locally, thus achieving increased stirring (see also the cross-section in FIG. 7*b*).

Figure 8:
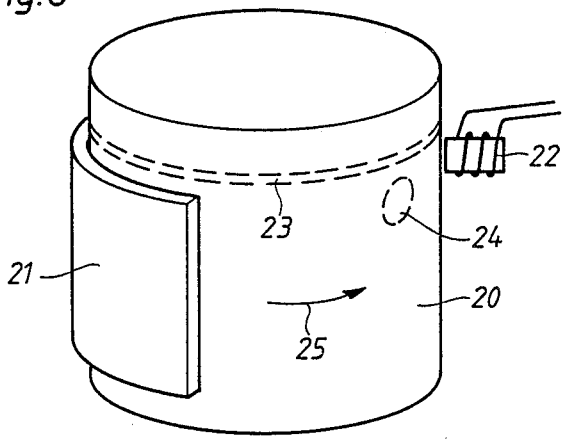
FIG. 8 is a schematic perspective view showing an arrangement for carrying out the method of the invention using a horizontal stirrer and an electromagnet.

In prior art ladles with normal stirring, the removal of sulfur from steel proceeds relatively slowly. By use of the method according to the invention, among other things according to FIG. 8, the rate of mixing of slag and melt, and therefore the sulfur removal, can be improved. A horizontally-acting stirrer 21, acting in the circumferential direction, is placed against a ladle 20. Diametrically opposite thereto, or somewhat angularly located in relation thereto, there is arranged an electromagnetic coil 22 which generates a field of force at the surface of the melt, i.e. which acts as an electromagnetic brake. At the location of the coil 22, the interface between the slag and the melt is disturbed, thus obtaining a vigorous mixing. FIG. 8 shows the location of the coil 22 in relation to a layer 23 of slag.

The stirrer 21 generates rotation of the melt in the direction of the arrow 25 and the perturbation of the rotary flows induced by the coil 22 will have its initial effect upstream of the coil so that the enhanced mixing starts at 24.

The method according to the above can be varied in many ways within the scope of the following claims.

What is claimed is:

1. A method of reducing lining wear in connection with heating by at least one electric arc, steel melt being stirred in a horizontal direction by means of an electromagnetic stirring device, thus creating a concave surface to the melt, wherein the slag present in the bath accumulates towards the center of the concave surface and the attack by slag against the lining is avoided, wherein said arc heats the charge and also melts the slag, but wherein the lining is partly protected from radiation heating from the arc by the outer parts of the concave surface; wherein a perturbing device is immersed into the interface between the melt and the slag in order to bring about an efficient mixing of the steel melt and the slag for intensifying the sulphur removal.

2. A method according to claim 1, wherein the perturbing means comprises a refractory dowel or stone projecting into the melt.

3. A method according to claim 1, wherein the perturbing means comprises a refractory wing located below the bath surface.

4. A method according to claim 1, wherein the perturbing means comprises an electromagnetic brake.

5. A method according to claim 1, in which a refractory member extends across the interface between the melt and the slag layer in order to bring about an efficient mixing of the steel melt and the slag.

6. A method according to claim 1, in which the degree of curvature of the concave surface is increased by increasing the rate of melt rotation, whereby the arc current as well as the rate of consumption of electrode material can be reduced.

7. A method according to claim 1, in which the perturbing means comprises an electromagnetic pole lowered towards the melt, said pole being energized to depress the melt surface below it.

8. A method according to claim 1, in which an electromagnet supplied with direct current is positioned to act upon the surface of the melt to decelerate the melt relative to the rotation produced by the rotary stirring.

9. A method according to claim 1, in which the melt is stirred by a first horizontally acting, electromagnetic stirrer and by a second vertically acting stirrer, separated from the first stirrer, the second stirrer being arranged to increase the homogenization of the melt.

10. A method according to claim 1, in which the melt is stirred by a horizontally acting, electromagnetic first stirrer and the stirring is disturbed by an extra coil, substantially diametrically located in relation to the stirrer, said extra coil being supplied with direct current and acting as an electromagnetic brake.

11. A method according to claim 1, in which the melt is stirred by a horizontally acting, electromagnetic first stirrer and the stirring is disturbed by an extra coil, substantially diametrically located in relation to the stirrer, said extra coil being supplied with single phase alternating current and acting as an electromagnetic brake.

* * * * *